US005650573A

United States Patent [19]

Bruns et al.

[11] Patent Number: 5,650,573

[45] Date of Patent: Jul. 22, 1997

[54] MOTOR DRIVEN SCREWDRIVER

[75] Inventors: Joachim Bruns, Lichtenwald; Joachim Graf, Pfaffenhofen, both of Germany

[73] Assignee: Robert Bosch GmbH, Stuttgart, Germany

[21] Appl. No.: 701,971

[22] Filed: Aug. 23, 1996

Related U.S. Application Data

[63] Continuation of Ser. No. 278,947, Jul. 22, 1994, abandoned.

[30] Foreign Application Priority Data

Aug. 31, 1993 [DE] Germany ..... 43 29 200.3

[51] Int. Cl.[6] ..... B25B 23/00

[52] U.S. Cl. ..... 73/862.21; 73/862.191; 73/862.321; 81/57.31; 81/467

[58] Field of Search ..... 73/862.21, 862.23, 73/862.333, 862.335; 81/57, 57.11, 57.31, 429, 467

[56] References Cited

U.S. PATENT DOCUMENTS

| | | | |
|---|---|---|---|
| 2,756,622 | 7/1956 | LaBelle | 81/429 |
| 3,589,489 | 6/1971 | Fehlings | 81/57.31 |
| 3,803,952 | 4/1974 | Whale, Jr. | 81/429 |
| 3,934,629 | 1/1976 | Boman | 81/429 |
| 4,333,220 | 6/1982 | Aspers | 81/467 |
| 4,366,871 | 1/1983 | Dieterle et al. | 81/57.31 |

*Primary Examiner*—Richard Chilcot
*Assistant Examiner*—Ronald Biegel
*Attorney, Agent, or Firm*—Michael J. Striker

[57] ABSTRACT

A motor driven screwdriver has a drive train including a driving shaft, a driven shaft, and a planetary transmission arranged between the shafts, a measuring value transducer located in the drive train for determining a torque transmitted in the drive train, the measuring value transducer having a torsion shaft which transmits the drive torque, the torsion shaft being formed as a part of the driven shaft, and the driven shaft having an end which faces the planetary transmission and carries planetary gears of the planetary transmission.

8 Claims, 1 Drawing Sheet

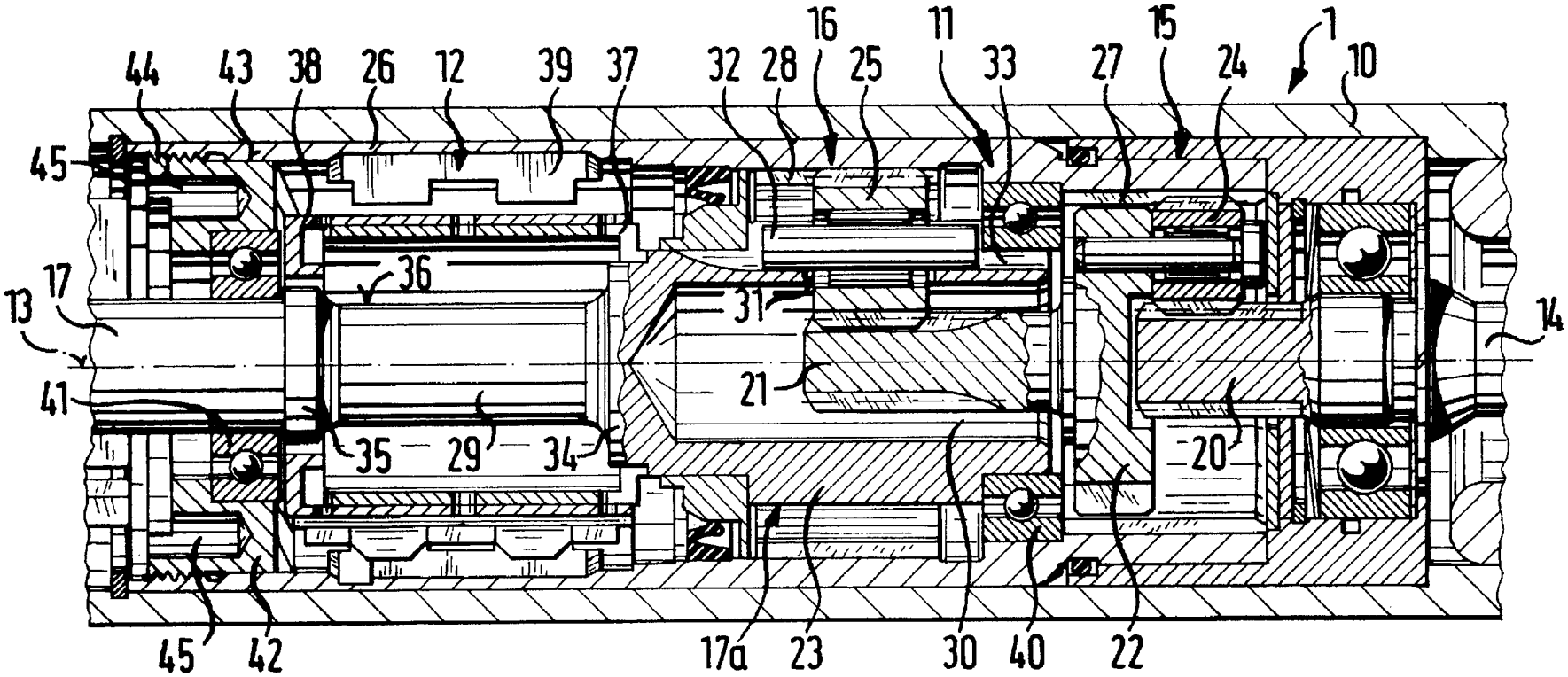
14
10
1
24
15
27
33
11
25
16
28
32
37
39
12
26
38
43
44
45
17
13
41
45
42
40
30
23
17a
22
20
21
31
34
29
35
36

MOTOR DRIVEN SCREWDRIVER

This is a continuation of application Ser. No. 08/278,947 filed Jul. 22, 1994. Now abandoned.

BACKGROUND OF THE INVENTION

The present invention relates to a motor driven screwdriver.

More particularly, it relates to a motor driven screwdriver with a planetary transmission arranged between a driving shaft and a driven shaft and a measuring value transducer for determining a drive torque transmitted by a drive train.

Motor driven screwdrivers of the above mentioned general type are known in the art. One of such motor driven screwdrivers is disclosed for example in the German document DE 32 14 889. The measuring value transducer has a torsion shaft which is connected through an end toothing with a carrier sleeve of a planetary transmission on the one hand and is connected with a driven shaft on the other hand and not supported separately. Due to the unavoidable play in the toothings the measuring accuracy of the measuring value transducer is affected. In another embodiment the measuring value transducer is formed as a separate structural group with its own housing and supported inside the housing. Such a construction increases the measuring accuracy, however, it is connected with relatively great number of parts and also requires a great mounting space.

SUMMARY OF THE INVENTION

Accordingly, it is an object of the present invention to provide a motor driven screwdriver which avoids the disadvantages of the prior art.

In keeping with these objects and with others which will become apparent hereinafter, one feature of the present invention resides, briefly stated, in a motor driven screwdriver in which the torsion shaft is formed as a part of the driven shaft, and the end of the driven shaft which faces the planetary transmission carries planetary gears of the planetary transmission.

When the motor driven screwdriver is designed in accordance with the present invention, it eliminates the disadvantages of the prior art. It has a measuring value transducer which provides a high measuring accuracy during determination of the drive torque without additional bearing points also in unfavorable operational positions. Moreover, the number of parts of the screwdriver is reduced and it occupies a smaller space.

In accordance with further features of the present invention, the end of the driven shaft facing the driving shaft is provided with a central opening in which a sun wheel of the planetary transmission is arranged. The planetary gears can be held on the driven shaft by axles, which are inserted in longitudinal grooves arranged in the end of the driving shaft. The planetary gears can engage into the interior of the central opening of the driven shaft through radial throughgoing openings in the wall of the latter.

In accordance with further features of the present invention a supporting sleeve surrounds the planetary transmission and extends in an axial direction in form of a sleeve beyond the measuring value transducer. Two roller bearings can be located inside the supporting sleeve at a great distance from one another to support the driving shaft. Due to the axially spaced support for the driving shaft inside the supporting sleeve, the bearing accuracy of the driving sleeve and thereby the measuring accuracy of the measuring value transducer are substantially improved.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a view showing a partial section of a motor driven screwdriver in accordance with the present invention.

DESCRIPTION OF THE PREFERRED EMBODIMENTS

A screwdriver shown in the drawings is identified with reference numeral 1. The inventive screwdriver has a rotation-symmetrical housing 10 with a two-stage planetary transmission 11 and a measuring value transducer 12 arranged in it. A driving shaft 14 is arranged concentrically to an axis 13 of the housing 10 and rotatably driven by a not shown drive motor. The driving shaft 14 drives a driven shaft 17 through a first transmission stage 15 and a second transmission stage 16. The driving shaft 14 and the driven shaft 17 are in alignment with one another. The driven shaft 17 is connectable with a screwing tool at its end which is not shown in the drawings. The driving shaft 14, the planetary transmission 11, and the driven shaft 17 together form a drive train from the drive motor to the screwing tool.

Each transmission stage 15, 16 includes in a known manner a central sun gear 20, 21 provided with outer teeth and a planetary carrier 22, 23 provided with three planetary gears. From total six planetary gears of the planetary transmission 11 one planetary gear per each transmission stage 15, 16 is shown in a section. A first planetary gear 24 is in engagement with the sun gear 20 of the first planetary transmission stage and a second planetary gear 25 is in engagement with the associated sun gear 21 of the second planetary transmission stage 16. A supporting sleeve 26 is fixed with respect to the housing. It surrounds the transmission stages 15, 16 and is provided on its inner side with toothings 27, 28 in which the planetary gears 24, 25 roll. All planetary gears 24, 25 are rollingly supported on needle sleeves.

The planetary carrier 22 of the first planetary transmission stage 15 on its side facing away from the drive motor has an axially projecting coaxial pin having an outer toothing. It forms the sun gear 21 of the second transmission stage 16. The planetary carrier 23 of the second planetary transmission stage 16 is connected one piece with the driven shaft 17. The end 17*a* of the driven shaft 17 which faces the drive motor is for this purpose provided with a central opening 30 in which the sun gear 21 of the second planetary transmission stage 16 extends. The wall of the planetary carrier 23 has radial throughgoing openings 31 for passing the second planetary gears 25. The second planetary gears 25 are supported rotatably around an axle 32. For holding the axle 32, longitudinal grooves 33 are provided on the outer periphery of the planetary carrier 23 and receive the axles 32.

The measuring value transducer 12 is connected with the second transmission stage 16. The measuring value transducer 10 has a torsion shaft 29 which transmits the respective drive torque of the screwdriver 1 and has a torsion elastic portion 36 between two shaft flanges 34, 35. The torsion shaft 29 is formed on the driven shaft 17. The first shaft flange 34 located closer to the drive motor has an inner sleeve 34 extending coaxially to the axis 13 over the whole torsion-elastic portion 36. An outer sleeve 38 is held on the second shaft flange 36 so as to surround the inner sleeve 37 and extend to the first shaft collar 34.

During the operation with the screwdriver 1, a drive torque is transmitted through the driving shaft 14, the planetary transmission 11 and the driven shaft 17. Depending on the magnitude of the drive torque, the driven shaft 17 is twisted in the region of the torsion elastic portion 36, and the second flange 35 is turned in a peripheral direction relative to the first flange 34. Since the inner sleeve 37 is fixedly connected with the first collar 34 and the outer sleeve 38 is fixedly connected with the second collar 35, the outer sleeve 38 is displaced relative to the inner sleeve 37 respectively. The displacement of the sleeves 37, 38 is detected by a coil element 39 and transmitted to a not shown measuring device. The operation of the measuring value transducer 12 is not germane to the present invention. In order to illustrate the functions of such a measuring value transducer, reference is made here to the German document DE 33 07 105 C2, which is incorporated here by way of the reference with its full disclosure.

The driven shaft 17 is supported in two bearing points which are axially spaced from one another. A first roller bearing 40 is arranged at the end of the driven shaft 17 between the first transmission stage 15 and the second transmission stage 16. A second roller bearing 41 is located behind the second shaft flange 35 of the measuring value transducer 12 as considered in direction from the drive motor. The support of the driven shaft 17 is performed in both bearing points relative to the supporting sleeve 26. The supporting sleeve 26 extends for this purpose in an axial direction over the measuring value transducer 12 and beyond it. Between the second roller bearing 41 and the sleeve 26, an adjusting ring 42 is arranged for adjusting the first roller bearing 41 in the axial direction. The adjusting ring 42 forms a press fit 43 on its outer side with the supporting sleeve 26, so that the second roller bearing 41 is exactly fixed in the radial direction. The adjusting ring 42 at its front end which faces the screwing tool is provided with an outer thread 44 cooperating with a corresponding inner thread of the supporting sleeve 26. Finally, at its end side facing the tool, the adjusting ring 42 is provided with openings 45 for placing an adjusting tool which can turn the adjusting ring 42 in a peripheral direction relative to the sleeve 26 and therefore adjust it axially by means of the outer thread 44 within certain limits.

Since the torsion-elastic portion 36 is provided on the driven shaft 17, the screwdriver has a compact construction. Due to the supporting sleeve 26 extending in the axial direction over the measuring value transducer 13, an exact support of the driven shaft 17 with a low number of structural elements is possible. An additional support of the torsion-elastic portion 36 is dispensed with. The supporting sleeve 26 with the planetary transmission 11 and the measuring value transducer 12 located in it is surrounded by a screwdriver housing 10 which is formed as a single part.

It will be understood that each of the elements described above, or two or more together, may also find a useful application in other types of constructions differing from the types described above.

While the invention has been illustrated and described as embodied in a motor driven screwdriver, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A motor driven screwdriver, comprising a driven train including a driving shaft, a driven shaft having an end connectable with a screwdriving tool, and a planetary transmission arranged between said shafts and having planetary gears and a planetary carrier; a measuring value transducer located in said drive train for determining a torque transmitted in said drive train, said measuring value transducer having a torsion shaft which transmits the drive torque, said torsion shaft being formed as a part of said driven shaft and having a torsion-elastic portion formed of one piece with said driven shaft, said transmission carrier being formed of one piece with said driven shaft and located between said driving shaft and said torsion shaft, said driven shaft having an end which faces said planetary transmission and carries planetary gears of said planetary transmission; a supporting sleeve which surrounds said planetary transmission and extends in a sleeve-like fashion over said measuring value transducer; and two roller bearings including a first roller bearing located axially before said planetary gears and said planetary carrier of said planetary transmission as seen in direction from said driving shaft, and a second roller bearing located axially behind said torsion shaft of said measuring value transducer as seen in direction from said driving shaft, said driven shaft being supported by said first and second bearings inside said supporting sleeve turnably relative to the latter.

2. A motor driven screwdriver as defined in claim 1, wherein said torsion shaft has two axially spaced shaft flanges and a torsion-elastic portion located between said flanges.

3. A motor driven screwdriver as defined in claim 1, wherein said driven shaft has an end facing said driving shaft and provided with a central opening, said planetary transmission having a sun wheel arranged in said central opening.

4. A motor driven screwdriver as defined in claim 3; and further comprising axles with which said planetary gears are held on said driven shaft.

5. A motor driven screwdriver as defined in claim 4, wherein said driving shaft has an end provided with longitudinal grooves, said axles being arranged in said longitudinal grooves.

6. A motor driven screwdriver as defined in claim 5, wherein said driven shaft has a wall provided with radial throughgoing openings, said planetary gears extending through said radial throughgoing openings into said central opening of said end of said driven shaft.

7. A motor driven screwdriver as defined in claim 1; and further comprising a hollow gear and an adjusting ring, said second roller bearing being adjustable in an axial direction inside said hollow gear by said adjusting ring.

8. A motor driven screwdriver as defined in claim 7, wherein said adjusting ring forms with said supporting sleeve a radial press fit and simultaneously is in a thread connection with said supporting sleeve.

* * * * *